US007580660B2

(12) United States Patent
Sato et al.

(10) Patent No.: US 7,580,660 B2
(45) Date of Patent: Aug. 25, 2009

(54) DEVELOPING ROLLER, PROCESS FOR PRODUCING DEVELOPING ROLLER, PROCESS CARTRIDGE AND IMAGE FORMING APPARATUS

(75) Inventors: Tadashi Sato, Suntou-gun (JP); Yosuke Ata, Suntou-gun (JP); Saki Tominaga, Suntou-gun (JP); Momosuke Takaichi, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/248,292

(22) Filed: Oct. 9, 2008

(65) Prior Publication Data

US 2009/0041499 A1 Feb. 12, 2009

Related U.S. Application Data

(63) Continuation of application No. PCT/JP2008/057651, filed on Apr. 15, 2008.

(30) Foreign Application Priority Data

Apr. 20, 2007 (JP) ..... 2007-111784

(51) Int. Cl.
*G03G 15/08* (2006.01)

(52) U.S. Cl. ..... 399/286

(58) Field of Classification Search ..... 399/286, 399/279, 265, 111; 430/120.1; 492/53, 56
See application file for complete search history.

(56) References Cited

U.S. PATENT DOCUMENTS

2003/0118372 A1* 6/2003 Kitano et al. ..... 399/286 X
2005/0238392 A1* 10/2005 Okamoto et al. ..... 399/269
2009/0035027 A1* 2/2009 Shirose et al. ..... 399/286

FOREIGN PATENT DOCUMENTS

| | | | |
|---|---|---|---|
| JP | 5-156165 | A | 6/1993 |
| JP | 8-127675 | A | 5/1996 |
| JP | 9-59456 | A | 3/1997 |
| JP | 10-48916 | A | 2/1998 |
| JP | 2001-227530 | A | 8/2001 |
| JP | 2002-147437 | A | 5/2002 |
| JP | 2003-195597 | A | 7/2003 |

OTHER PUBLICATIONS

International Search Report, dated Jul. 22, 2008, of PCT/JP2008/057651, filed Apr. 15, 2008.

* cited by examiner

*Primary Examiner*—Sophia S Chen
(74) *Attorney, Agent, or Firm*—Fitzpatrick, Cella, Harper & Scinto

(57) ABSTRACT

A developing roller has a conductive shaft member, a conductive elastic layer formed around the shaft member in a thickness of 0.5 mm to 6.0 mm, and a surface layer. The elastic layer contains carbon black and silicone rubber. The carbon black is in a content of 7% to 17% by mass and has at least two peaks in its particle size number distribution. The minimum diameter peak center in the particle size number distribution is within the range of 10 nm to 40 nm. The elastic layer has density within the range of 1.01 g/cm$^3$ to 1.07 g/cm$^3$. Where the ratios of carbon atoms to silicon atoms (C/Si), in the vicinity of the surface of the elastic layer, at depths of 100 μm and 200 μm from the surface of the elastic layer are represented by X, Y and Z, respectively, the X, Y and Z satisfy a specific relationship.

6 Claims, 5 Drawing Sheets

DEVELOPING ROLLER, PROCESS FOR PRODUCING DEVELOPING ROLLER, PROCESS CARTRIDGE AND IMAGE FORMING APPARATUS

CROSS-REFERENCE TO RELATED APPLICATIONS

This application is a continuation of International Application No. PCT/JP2008/057651, filed Apr. 15, 2008, which claims the benefit of Japanese Patent Application No. 2007-111784, filed Apr. 20, 2007.

BACKGROUND OF THE INVENTION

1. Field of the Invention

This invention relates to a developing roller used in image forming apparatuses such as printers and copying machines and in electrophotographic process cartridges, a process for producing the same, and an electrophotographic process cartridge and an image forming apparatus which have the developing roller.

2. Description of the Related Art

In general, developing rollers are basically constituted of a shaft member made of an electrically good conductive metal and a conductive elastic layer which covers the shaft member on its peripheral surface (see Japanese Patent Application Laid-open No. 2002-147437).

As the conductive elastic layer, those in which a conductive agent such as carbon black has been dispersed in silicone rubber are in wide use (see Japanese Patent Application Laid-open No. 2001-227530). This Japanese Patent Application Laid-open No. 2001-227530 presents a problem that, where such a conductive elastic layer is formed by cast molding, the conductive agent may unwantedly become unevenly distributed to the side of the shaft member causing non-uniform electrical conductivity. Then, it discloses that, to resolve such a problem, a liquid silicone rubber having a particular specific gravity mixed with carbon black having a particular DBP oil absorption is used to form a conductive elastic layer so as to achieve conductive elasticity with a uniform volume resistivity.

Now, the above-mentioned Japanese Patent Application Laid-open No. 2002-147437 proposes, as the structure of a developing roller, which is so constituted that a conductive elastic layer is further provided thereon with a surface layer in order to prevent the surface from becoming contaminated.

The present inventors have forwarded the development of developing rollers which can provide high-grade electrophotographic images, knowing that the use of the surface layer that covers the conductive elastic layer is inevitable in order to keep the developing roller surface effectively from becoming contaminated. In that course, they have come to be aware that, when electrophotographic images are formed using a developing roller having a conductive elastic layer in which carbon black has uniformly been dispersed to make the layer have a uniform volume resistivity and a surface layer formed on the elastic layer, ghost images may occur which are caused by such a developing roller. The ghost images refer to images formed when reproduced images having previously been printed remain on a developing roller and are formed as accidental images superimposedly on intended images in synchronization with the rotational periods of the developing roller. Then, such ghost images have been found to occur remarkably on the developing roller made up to have a conductive elastic layer and a surface layer superposed thereon, where the present inventors have presumed that such ghost images occur because of the presence of the surface layer.

SUMMARY OF THE INVENTION

Accordingly, an object of the present invention is to provide a developing roller having a shaft member, a conductive elastic layer which covers the shaft member and contains silicone rubber and carbon black as a conductive agent, and a surface layer, and also being capable of keeping the ghost images from occurring; and a process for producing the same.

Another object of the present invention is to provide an electrophotographic process cartridge and an image forming apparatus which can form good electrophotographic images having fewer ghost images (residual images along rotational periods of developing roller).

In view of the above-mentioned objects, the present inventors have further made many studies on the developing roller having a conductive elastic layer and a surface layer provided thereon. As a result, they have presumed that the ghost images occur on the basis of such a mechanism as stated below. That is, an interface between the conductive elastic layer and the surface layer functions as a very weak resistance layer, at which electric charges stagnate and are present as residual electric charges. Such residual electric charges cause a difference in potential between developed areas and non-developed areas which is produced over the surface of the developing roller, where the residual images may be formed on intended images and thus the ghost images may occur.

Under such a presumption, they have made many studies on how a developing roller may be constituted which can keep the electric charges from stagnating at the interface between the conductive elastic layer and the surface layer, and have discovered that the above-mentioned objects can well be achieved by making the ratio of carbon black to silicone rubber higher in the elastic layer at a part nearer to the vicinity of the interface. Thus, they have accomplished the present invention.

More specifically, the developing roller according to the present invention is a developing roller having a conductive shaft member, a conductive elastic layer formed around the shaft member in a thickness of 0.5 mm to 6.0 mm, and a surface layer, and is characterized in that the elastic layer contains carbon black and silicone rubber serving as a binder for the carbon black, the carbon black is in a content of 7% by mass to 17% by mass based on the mass of the elastic layer, the carbon black in the elastic layer has at least two peaks in its particle size number distribution, the minimum diameter peak center in the particle size number distribution is within the range of 10 nm to 40 nm, the elastic layer has density within the range of 1.01 g/cm$^3$ to 1.07 g/cm$^3$, and, where the ratio of carbon atoms to silicon atoms (C/Si) in the vicinity of the surface of the elastic layer is represented by X, the ratio of carbon atoms to silicon atoms at a depth of 100 μm from the surface of the elastic layer by Y, and the ratio of carbon atoms to silicon atoms at a depth of 200 μm from the surface of the elastic layer by Z, the X, the Y and the Z satisfy the relationships of the following expressions (1) and (2):

$$1.50 \geqq X/Y \geqq 1.10 \quad (1);$$

and $$1.10 \geqq Y/Z \geqq 1.02 \quad (2).$$

According to such a constitution of the invention, the developing roller is so made up that the electric current may readily flow in the vicinity of the surface of the conductive elastic layer, and this enables, in the developing roller of a multi-layer construction where a surface layer is formed on the conductive elastic layer, to effectively keep ghost images from occurring that may be caused by the interface between the elastic layer and the surface layer.

As described above, according to the present invention, in the developing roller of a multi-layer construction, having a conductive elastic layer and a surface layer provided on the elastic layer, the ghost images can effectively be kept from occurring that are presumed to be caused by such a multi-layer construction of the developing roller. The developing roller can also be kept from being stained because of, e.g., the agglutination of a developer to its surface that is due to the fact that the surface layer is provided.

Further, the use of such a developing roller enables an image forming apparatus, and an electrophotographic process cartridge usable therein, to be provided which can stably form high-grade electrophotographic images having fewer ghost images.

Further features of the present invention will become apparent from the following description of exemplary embodiments with reference to the accompanying drawings.

DESCRIPTION OF THE EMBODIMENTS

Figure 1:
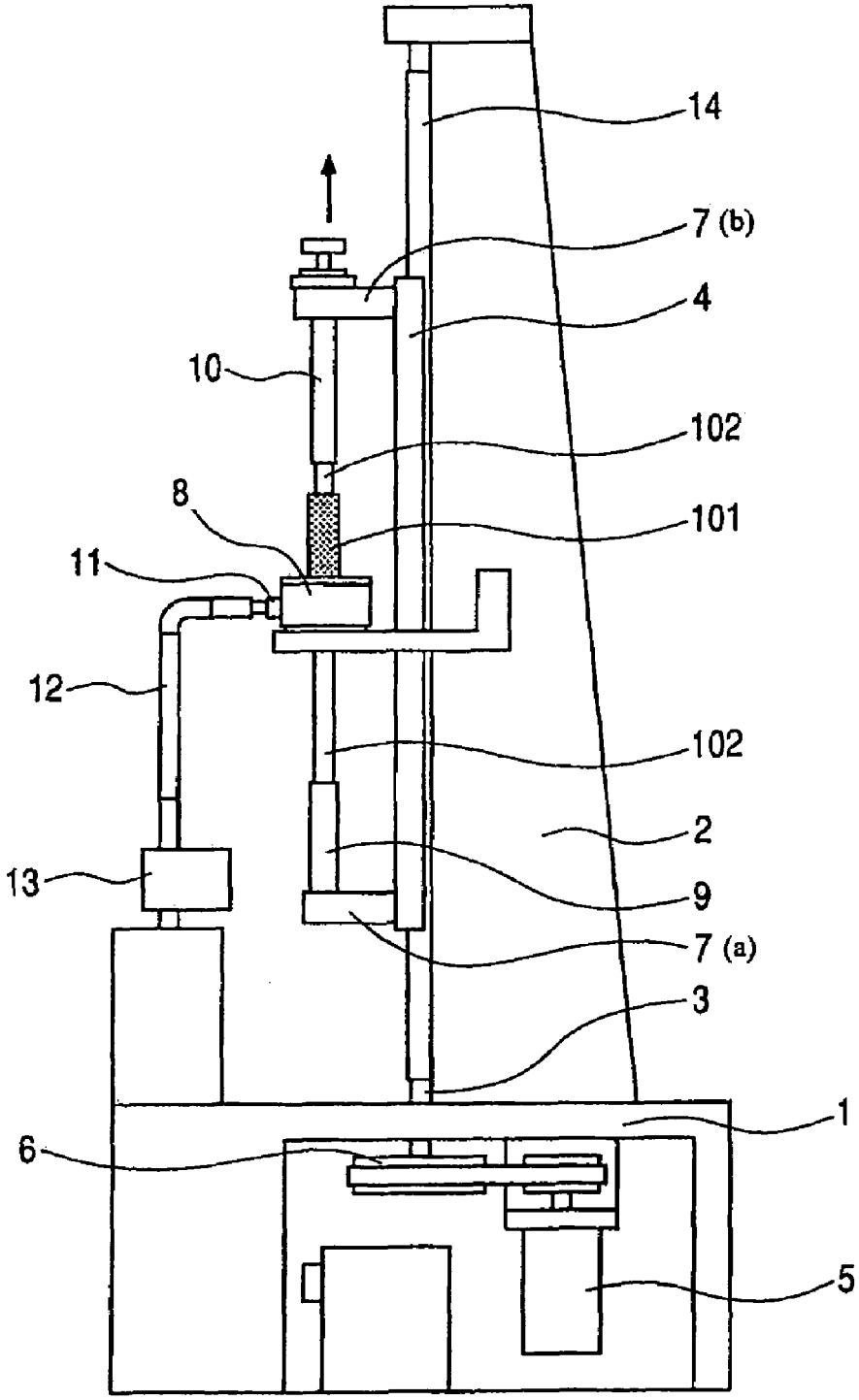
FIG. 1 is a sectional view schematically showing a coating apparatus in the present embodiment.

The developing roller according to the present invention, the process for producing the developing roller, the developing roller produced by the production process, and the electrophotographic process cartridge and the image forming apparatus which have the developing roller and so forth are described below in detail.

The developing roller according to the present invention has a conductive shaft member, a conductive elastic layer formed around the shaft member in a thickness of 0.5 mm to 6.0 mm, and a surface layer.

The elastic layer contains carbon black and silicone rubber serving as a binder, of the carbon black. The carbon black is in a content of 7% by mass to 17% by mass based on the mass of the elastic layer.

The carbon black in the elastic layer has at least two peaks in its particle size number distribution, and the minimum diameter peak center in the particle size number distribution is within the range of 10 nm to 40 nm.

The elastic layer has density within the range 1.01 g/cm$^3$ to 1.07 g/cm$^3$.

Further, where the ratio of carbon atoms to silicon atoms (C/Si) in the vicinity of the surface of the elastic layer is represented by X, the ratio of carbon atoms to silicon atoms at a depth of 100 μm from the surface of the elastic layer by Y, and the ratio of carbon atoms to silicon atoms at a depth of 200 μm from the surface of the elastic layer by Z, the X, the Y and the Z satisfy the relationships of the following expressions (1) and (2):

$$1.50 \geqq X/Y \geqq 1.10 \quad (1); \text{ and}$$

$$1.10 \geqq Y/Z \geqq 1.02 \quad (2).$$

The reference characters X, Y and Z represent the presence proportion of carbon atoms to silicon atoms at three positions, i.e., in the vicinity of the surface of the elastic layer, at a depth of 100 μm from the surface of the elastic layer and at a depth of 200 μm from the surface of the elastic layer, respectively. Then, what is meant by "the X, the Y and the Z satisfy the relationships of the expressions (1) and (2)" is that, in a sectional shape of the elastic layer, the presence proportion of carbon atoms to silicon atoms in the elastic layer becomes higher at a part of the elastic layer nearer to its surface. This makes the developing roller have a relatively high electrical conductivity in the vicinity of its surface to bring out the effect of reducing the electric charges remaining at the interface between the elastic layer and the surface layer. The value of X/Y may preferably be from 1.20 or more to 1.40 or less. The value of Y/Z may preferably be from 1.05 or more to 1.20 or less.

If the value of X/Y is less than 1.10 or the value of Y/Z is less than 1.02, it is difficult to reduce the occurrences of the ghost images. This is considered due to the fact that the electric current flowing at the elastic layer surface is so low as to make the developing roller easily affected by the interface standing a very weak resistance.

If the value of X/Y is more than 1.50 or the value of Y/Z is more than 1.10, the electric current may undesirably leak to the photosensitive drum side. This is considered due to the fact that the elastic layer surface becomes too low in surface resistance.

Re silicone rubber

Silicone rubber is used as a binder making up the elastic layer. This is because the elastic layer can have an appropriately low hardness and a good deformation recovery power.

As a raw material for the silicone rubber, it is preferable to use an addition reaction cross-linked liquid silicone rubber (hereinafter also "liquid silicone rubber"). The liquid silicone rubber is a composition containing, e.g., an organopolysiloxane having an alkenyl group and an organohydrogenpolysiloxane, and further containing a catalyst and any other appropriate additive(s). The organopolysiloxane is a base polymer of the silicone rubber raw material, and may preferably have a molecular weight of, but not particularly limited to, from 10,000 or more to 1,000,000 or less in weight-average molecular weight, and more preferably from 50,000 or more to 700,000 or less in weight-average molecular weight.

The alkenyl group of the organopolysiloxane has a moiety capable of reacting with the active hydrogen atoms of the organohydrogenpolysiloxane. The alkenyl group may include, as preferred specific examples thereof, a vinyl group and an allyl group which are highly reactive with the active hydrogen atoms. In particular, the vinyl group is more preferred. The organohydrogenpolysiloxane functions as a cross-linking agent of the addition reaction in a curing step, and may be a polymer having two or more hydrogen atoms bonded to the silicon atom in one molecule, and preferably three or more hydrogen atoms in order to carry out the curing reaction preferably.

There are no particular limitations on the average molecular weight of the organohydrogenpolysiloxane. It may preferably have a weight-average molecular weight of approximately 1,000 to 10,000. In order to carry out the curing reaction favorably, it may preferably be a polymer having a weight-average molecular weight of 1,000 or more to 5,000 or less, having a relatively low molecular weight.

The liquid silicone rubber may preferably contain a known platinum series catalyst as a cross-linking catalyst of the organohydrogenpolysiloxane. For example, it may include platinum itself, platinum compounds, chloroplatinic acid, alcohol compounds or ether compounds of chloroplatinic acid, and platinum complexes with hydrates. A transition metal compound capable of showing catalytic action in hydrosilylation reaction may also be used as the cross-linking catalyst. The cross-linking catalyst may be added in an amount ranging from 1 ppm or more to 2,000 ppm or less in terms of platinum atoms or transition metal atoms, based on the organopolysiloxane.

The elastic layer according to the present invention, which is to be so made up that the ratio of carbon atoms to silicon atoms present therein changes in its thickness direction, is achievable by an elastic layer in which the conductive carbon black is present in a ratio made higher toward the surface side, with respect to the silicone rubber as a binder resin.

More specifically, the carbon black is unevenly distributed in such a way that the carbon black is densely present as it comes nearer to the surface side of a single-layer elastic layer composed of the carbon black and the silicone rubber. This enables the elastic layer to satisfy the relationship of the expressions (1) and (2).

The liquid silicone rubber as a raw material used to obtain such an elastic layer is required to be mixed with carbon blacks having different particle diameters so that the peaks in particle size number distribution may be formed separately in at least two peaks.

Herein, the particle size number distribution refers to the primary particle size distribution of carbon black that is obtained by a carbon black particle diameter measuring method.

If the peak of primary particle diameter (hereinafter noted as "particle diameter") is single and further the peak center is present in a region of small particle diameters in the particle size number distribution, carbon blacks may have certain strongly aggregation properties, and hence it is difficult for such carbon blacks to be present in the vicinity of the elastic layer surface to which shear is applied at the time of molding. That is, the carbon black in the elastic layer tends to be low in concentration as it comes nearer to the vicinity of the surface of the elastic layer. Besides, where only carbon black having a large particle diameter is used, it is difficult for such carbon black to form their mutual network, and hence it is necessary for the carbon black to be mixed in excess. Accordingly, the resultant carbon black in the elastic layer may adversely affect physical properties. such as compression set and impact resilience of the elastic layer.

However, the elastic layer may be formed using the liquid silicone rubber which is so mixed with carbon blacks that the peaks in particle size number distribution of carbon black may be formed separately in at least two peaks, whereby the resultant carbon black in the elastic layer is present in a larger quantity in the vicinity of the surface of the resultant elastic layer.

Any detailed mechanism thereof is unclear, and may be presumed as stated below. That is, a carbon black having weak aggregation properties contained in the liquid silicone rubber convects in the liquid silicone rubber by virtue of a shear force applied to the liquid silicone rubber when the elastic layer is formed by molding. Concurrently therewith, a carbon black haying strong aggregation properties contained in the liquid silicone rubber comes to have a weakened aggregation force because of the presence of the carbon black having weak aggregation properties to come to be kept from being unevenly distributed to the inside of a layer coming to be the elastic layer. Some carbon black having weak aggregation properties may be absorbed in the carbon black having strong aggregation properties, so that those being large in structure may be present, and they flow into the vicinity of the surface of the layer coming to be the elastic layer, by virtue of the convection taking place from the inner side to the outer side of the elastic layer. As a result, the resultant carbon black in the elastic layer is higher in concentration as it comes nearer to the vicinity of the surface of the elastic layer.

In regard to the carbon blacks to be mixed in the liquid silicone rubber, they are so mixed that, among peaks in particle size number distribution, the center of a peak positioned on the smallest particle diameter side (hereinafter also "minimum diameter peak center") may be within the range of 10 nm to 40 nm. If the minimum diameter peak center is less than 10 nm, the carbon blacks may be so strongly aggregative as to be difficult for them to be uniformly dispersed in the liquid silicone rubber when they are in a small proportion to the polymer. If on the other hand the minimum diameter peak center is more than 40 nm, the carbon blacks may be so weakly aggregative as to tend to be well dispersible in the liquid silicone rubber, but may provide less of a carbon black network to tend to make electric current flow with difficulty. Here, carbon blacks that may provide the minimum diameter peak center of 10 nm to 40 nm are necessary to appropriately form the carbon black network. Of the carbon blacks used in the liquid silicone rubber, there are no particular limitations on the particle diameter of a carbon black having a larger particle diameter. It may be such a particle diameter that the carbon black having a larger particle diameter and a carbon black having a smaller particle diameter are used together so as to form separated peaks in particle size number distribution.

In the particle size number distribution, the center of a peak positioned on the side of larger particle diameter than the minimum diameter peak may preferably be at a position distant by at least 40 nm, or more than that, from the minimum diameter peak. This is to make it more successful that the presence ratio of carbon black to silicone rubber is made uneven in the thickness direction of the elastic layer as described above.

Where the minimum diameter peak is denoted as a peak $P_1$ in two or more kinds of particle diameters determined from a histogram of the particle size distribution of carbon black, a peak number ratio of the peak $P_1$ may preferably be from 25% or more to 70% or less. As long as the ratio is larger than 25%, the carbon black having a smaller particle diameter as stated above, which is to bring out conductivity, may be in a proper quantity to achieve electrical properties required as the developing roller. As long as the ratio is smaller than 70%, the carbon black having strong aggregation properties may be in such a quantity as to ensure that the carbon black in the vicinity of the elastic layer surface not low in concentration, which is preferable.

The carbon blacks may include those of the following types:

SAF (Super Abrasion Furnace);
ISAF (Intermediate Super Abrasion Furnace);
HAF (High Abrasion Furnace);
MAF (Medium Abrasion Furnace);
FEF (Fast Extruding Furnace);
GPF (General Purpose Furnace);
SRF (Semi Reinforcing Furnace);
FT (Fine Thermal); and
MT (Medium Thermal).

The carbon blacks may further include general-purpose carbon blacks, such as acidic carbon black subjected to oxidation treatment and thermally decomposed carbon black.

The carbon blacks to be mixed in the liquid silicone rubber may be in an amount of 7% by mass or more to 17% by mass or less in total, based on the mass of the liquid silicone rubber. This is to make the elastic layer have a volume resistivity of $10^3$ Ωcm or more to $10^8$ Ωcm or less, which is necessary for the elastic layer.

The elastic layer composed of a silicone rubber molded product may have density within the range of 1.01 g/cm$^3$ or more to 1.07 g/cm$^3$ or less. Usual silicone polymers have a density of about 0.98 g/cm$^3$ Then, if the elastic layer has a density of less than 1.01 g/cm$^3$, a filler is provided in a small packing ratio in the silicone polymer. Hence, a sufficient carbon black network may not be made even when a carbon black having especially strong conductivity is used, so that the elastic layer can not be provided with the desired volume resistivity in some cases.

If on the other hand the elastic layer has a density of more than 1.07 g/cm$^3$, a filler greatly different in density is mixed in a large quantity, and this may bring the carbon black (in the elastic layer) to be poorly dispersed in the vicinity of the shaft member to make it difficult to achieve electrical properties required of the developing roller.

The carbon black in the whole filler incorporated in the silicone rubber may preferably be in an area-equivalent proportion of 95% or more to 100% or less. This is because the state of dispersion of the carbon black in the silicone rubber can be made to be less affected, or be not affected at all, by any other filler.

The elastic layer may preferably have a thickness of 0.5 mm or more to 6.0 mm or less so as to bring out properties required as the developing roller. It may more preferably have a thickness of 2.0 mm or more to 3.0 mm or less. This is because the stress that may be applied to the developer and other members coming in contact with the elastic layer can be made small and the developing cartridge can be made compact.

How to Produce Developing Roller

How to produce the developing roller according to the present invention is described below.

First, the carbon blacks are mixed in the liquid silicone rubber to prepare a liquid silicone rubber composition. The carbon blacks are so mixed in the liquid silicone rubber that the carbon blacks may have at least two peaks in particle size number distribution and that the minimum diameter peak center in the particle size number distribution may be from 10 nm or more to 40 nm or less.

The liquid silicone rubber composition may optionally appropriately be mixed therein with various additives, such as a non-conductive filler and a plasticizer as long as the effect of the present invention is not damaged. The non-conductive filler may include silica, quartz, titanium oxide, calcium carbonate, zinc and alumina. The plasticizer may include polydimethylsiloxane oils, diphenylsilane diols, trimethyl silanols, phthalic acid derivatives and adipic acid derivatives. The liquid silicone rubber composition may also equally as well be mixed with a heat-resistant agent, a flame retardant, an anti-oxidizing agent, a cross-linking accelerator, a cross-linking retarder, a cross-linking assistant and a thixotropic agent.

Then, the conductive shaft member is provided on its outer peripheral side with a ring type coating head in such a way that it is concentric with the shaft member. This shaft member is moved in its axial direction relatively with respect to the coating head, where the liquid silicone rubber composition is fed from the coating head toward the peripheral surface of the shaft member. At this point, the liquid silicone rubber composition may preferably be set so as to have a yield stress of 20 Pa or more to 600 Pa or less.

Its yield stress may more preferably be within the range of 100 Pa or more to 400 Pa or less.

The yield stress (often called a yield point) refers to the limit stress at which a sample behaves as a solid when the stress is not higher than that. The sample deforms elastically like a spring, but, upon removal of this stress, does not further deform. At a point not higher than the yield stress, the stress applied and the deformation keep a proportional relationship. At a point exceeding the yield stress, a three-dimensional structure that continues to be formed by aggregate fillers begins to break structurally and the sample begins to flow. It continues to deform endlessly because of the stress applied and by no means returns to its original shape even after removal of the stress. It shows such characteristic features.

As long as the liquid silicone rubber composition has a yield stress within the range of 20 Pa or more to 600 Pa or less, the dimensional accuracy to coating thickness can be maintained, and at the same time can be balanced with the smoothness of a coating surface in the best condition.

The shaft member is a member that functions as an electrode and a support member. The shaft member may be made of a metal or an alloy, such as iron, aluminum, a copper alloy or stainless steel, which may be plated with chromium or nickel. It may preferably be in the shape of a column or the shape of a cylinder made hollow at its center. The shaft member may have any outer diameter determined appropriately, and may preferably have outer diameter within the range of 4 mm ore more to 20 mm or less in usual cases.

A molding machine making use of a ring type coating head is schematically shown in FIG. 1. The molding machine shown in FIG. 1. has a pedestal 1, a column 2 attached thereon substantially vertically and a precision ball thread 3 attached substantially vertically between the pedestal 1 and the top of the column 2. Reference numeral 14 denotes linear guides, and two linear guides 14 are attached to the column 2 in parallel with the precision ball thread 3. An LM (linear-motion) guide 4 is connected with the linear guides 14 and the precision ball thread 3 so as to be movable up and down as rotational movement is transmitted thereto from a servo motor 5 via a pulley 6. A ring-shaped coating head 8 which applies an uncured product of a silicone rubber composition to the peripheral surface of a shaft member 102 is attached on the outer peripheral side of the shaft member 102.

Further attached to the LM guide 4, is a lower side bracket 7(*a*) by which a shaft member lower part holding shaft 9 is substantially vertically attached, which holds and fastens the shaft member 102. A shaft member upper part holding shaft 10 which holds the roller shaft member 102 on its opposite side is also attached at its axis to an upper side bracket 7(*b*).

The shaft member upper part holding shaft 10 is so provided as to be opposite to and substantially concentric with the shaft member lower part holding shaft 9, to hold the shaft member therebetween. The ring-shaped coating head 8 is further supported at its axis by the shaft member lower part holding shaft 9 and the shaft member upper part holding shaft 10 each, in such a way that it is in parallel with the direction of movement of these shafts 9 and 10.

The axis of an ejection orifice (not shown) formed in a circular slit which opens on the inner side of the coating head 8 and the axes of the shaft member lower part holding shaft 9 and shaft member upper part holding shaft 10 are so controlled as to be substantially concentric with one another when the shaft member lower part holding shaft 9 and the shaft member upper part holding shaft 10 are moved up and down. As they are set up in this way, the axis of the ejection orifice of the coating head 8, formed in a circular slit, can substantially concentrically be fitted to the axis of the shaft member. Thus, a uniform space is formed between the inner peripheral surface of the ring-shaped coating head 8 and the outer peripheral surface of the shaft member 102.

A feed opening 11 though which the liquid silicone rubber composition is to be fed is connected to a material feed valve 13 via a pipe 12 for conveying the liquid silicone rubber composition. The material feed valve 13 is provided on its upstream side with a material mixer, a material feed pump, a material constant-rate ejection unit, a material tank and so forth so that the liquid silicone rubber composition can be ejected at a constant rate, i.e., rate per unit time is constant. The liquid silicone rubber composition is weighed out in a certain quantity from the material tank by means of the material constant-rate ejection unit, and is mixed by the material mixer. Thereafter, the liquid silicone rubber composition having been mixed is sent through the material feed valve 13 to the feed opening 11 via the pipe 12 by means of the material feed pump.

Further, the liquid silicone rubber composition is passed through a liquid silicone rubber composition flow path provided in the ring-shaped coating head 8 and is ejected out of a nozzle of the ring-shaped coating head. In order to make the liquid silicone rubber composition have a constant wall thickness, the rate of ejection from the ring-shaped coating head nozzle and the rate of feed from the material feed pump are set to be constant, where the shaft member holding shafts are moved up and down in the vertical direction (the axial direction of the shaft member). Thus, the shaft member is moved in the axial direction relatively to the recording head 8, so that a layer 101 of a cylinder-shaped (roller-shaped) uncured product composed of the liquid silicone rubber composition is formed on the peripheral surface of the shaft member. At this point, clearance between the shaft member and the ring-shaped coating head may preferably be set so as to correspond to the layer thickness of the desired elastic layer.

In the next step, the layer 101 of the uncured liquid silicone rubber composition formed around the shaft member is cured by heat treatment carried out by infrared heating, to form the elastic layer. The surface of the uncured liquid silicone rubber composition has viscous properties. Hence, as a method used for the heat treatment, the infrared heating is preferred, which is done without contact, may require simple equipment and enables the layer of the uncured liquid silicone rubber composition to be heat-treated uniformly in its lengthwise direction. In this heat treatment, an infrared heating unit may be set stationary and the shaft member provided with the cylinder-shaped (roller-shaped) uncured product layer formed of the liquid silicone rubber composition may be rotated in its peripheral direction, whereby the heat treatment is carried out uniformly in the peripheral direction. The heat treatment may be carried out at a temperature, which may depend on the liquid silicone rubber composition to be used, of 100° C. or more to 250° C. or less, at which the curing reaction begins.

Here, for the purposes of, e.g., stabilizing physical properties of the elastic layer formed after curing and removing any reaction residues and unreacted low-molecular content remaining in the elastic layer, the elastic layer having been subjected to infrared heating may further be subjected to secondary curing carried out by heat treatment or the like.

The elastic layer thus formed is further provided on its outer peripheral side with a surface layer for the purposes of wear resistance, toner chargeability and release properties. A material for forming the surface layer may include various polyamides, fluorine resins, hydrogenated styrene-butylene resins, urethane resins, silicone resins, polyester resins, phenolic resins, imide resins and olefin resins. Any of these materials may be used alone, or may be used in the form of a mixture of two or more of the materials. To these materials, various additives may be added as occasion calls.

These materials making up the surface layer may be dispersed by using a conventionally known dispersion machine making use of beads, such as a sand mill, a paint shaker, Daino mill and a ball mill. The resultant dispersion for surface layer formation may be coated on the surface of the elastic layer by spray coating or dipping. The surface layer may preferably be in a thickness of 5 μm or more for the purpose of preventing any low-molecular component(s) from exuding to thereby contaminate the photosensitive drum. It may also preferably be in a thickness of 50 μm or less for the purpose of preventing the elastic layer from being so hard as to cause melt adhesion. It may more preferably be in a thickness of 10 μm or more to 30 μm or less.

The developing roller of the present invention holds a developer thereon in the state it faces, or comes into touch or pressure contact with, a photosensitive drum (hereinafter also "photosensitive member") serving as an image bearing member which holds electrostatic latent images thereon. Then, the developing roller has a function that it provides the photosensitive drum with a toner as the developer to render the latent images visible as developer images. Further, the electrophotographic process cartridge and image forming apparatus of the present invention have this developing roller.

Figure 2B:
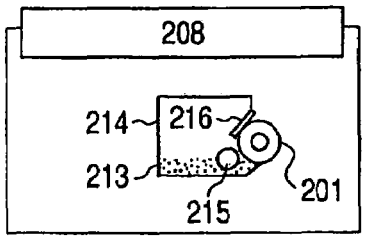
FIG. 2B shows a developing assembly used in the image forming apparatus.
Figure 2C:
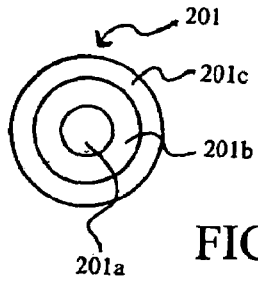
FIG. 2C shows developing roller, which includes a conductive shaft member, a conductive elastic layer, and a surface layer used in the developing assembly.
Figure 2A:
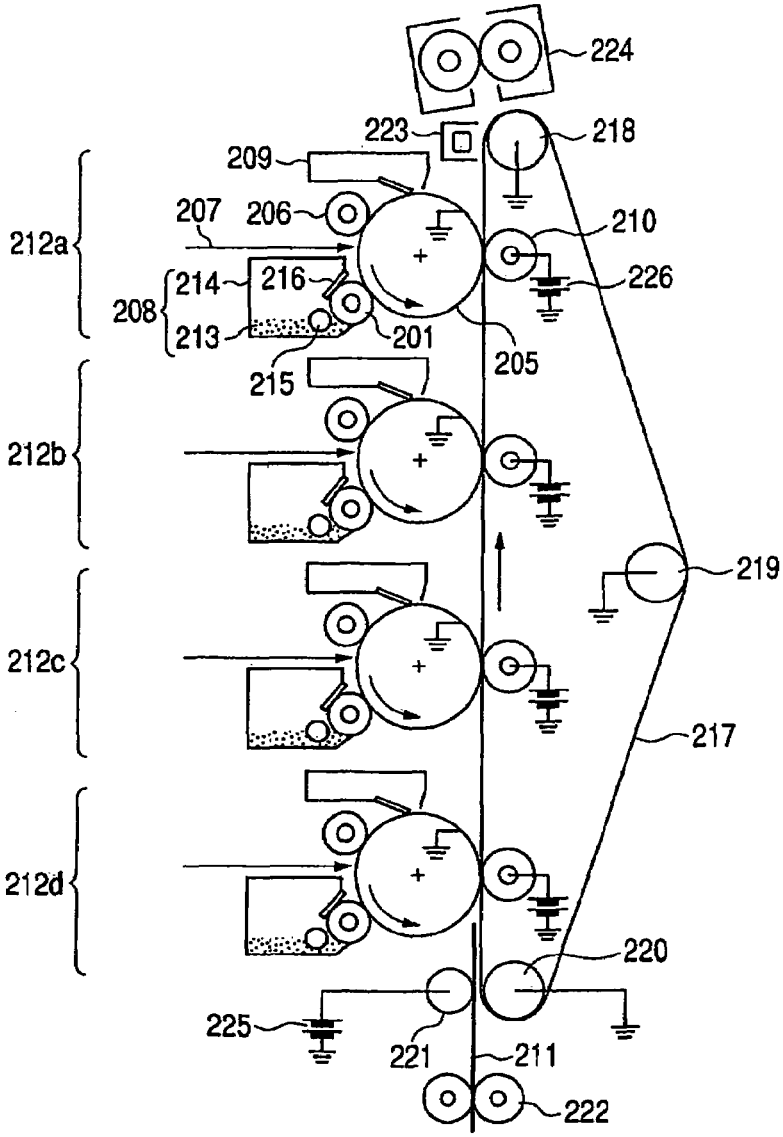
FIG. 2A is a structural view schematically showing the image forming apparatus of the present invention.

Examples of a process cartridge and an image forming apparatus which are commonly available, to which the developing roller of the present invention is mounted, are shown in FIG. 2A as a diagrammatic view. These are described below with reference to FIGS. 2A, 2B, and 2C. FIG. 2B shows a developing assembly used in the image forming apparatus. FIG. 2C shows developing roller 201, which includes a conductive shaft member 201 a, a conductive elastic layer 201*b*, and a surface layer 201*c* used in the developing assembly.

The image forming apparatus of the present invention has four image forming units 212*a* to 212*d* where yellow, cyan, magenta and black images, respectively, are formed, which are provided in tandem. These four image forming units 212*a* to 212*d* are the same in basic construction. Between the respective units, there may be some differences in what are adjusted depending on the properties of the respective-color toners, in respect of specifications for photosensitive members 205, charging assemblies 206, imagewise exposure means 207 (writing beams in what are shown in the drawing), developing assemblies 208, cleaning assemblies 209, image transfer assemblies 210 (transfer rollers in what are shown in the drawing) and so forth.

The photosensitive member 205, the charging assembly 206, the developing assembly 208 and the cleaning assembly 209 in each unit are integrally set up to form a detachably mountable process cartridge. As the process cartridge according to the present invention, a developing cartridge type is available which consists of the developing assembly 208. The developing assembly 208 is provided with a developer container 214 holding therein a one-component toner, and a developing roller 201 positioned at an opening extending in the developer container 214 in its lengthwise direction and set opposingly to a photosensitive member 205, and is se set up so as to develop electrostatic latent images held on the photosensitive member 205 to render them visible.

A toner feed roller 215 is also provided which feeds the one-component toner 213 to the developing roller 201 and at the same time scrapes off the developing roller 201 the one-component toner 213 remaining on the developing roller 201 without being used for development. A developer blade 216 is further provided which controls the level of the one-component toner 213 to be held on the developing roller 201 and at the same time charges the toner triboelectrically.

The surface of the photosensitive member 205 is uniformly charged by the charging assembly 206 to the desired polarity and potential, and image information is emitted from the imagewise exposure means 207 in the form of beams, with which the surface of the photosensitive member 205 thus charged is irradiated, thus the electrostatic latent images are formed. Then, onto the electrostatic latent images thus formed, the one-component toner 213 is fed from the developing assembly 208 having the developing roller 201 of the present invention, thus toner images are formed on the surface of the photosensitive member 205. As the photosensitive member 205 is rotated, the toner images thus formed come to the part opposing to the image transfer assembly 210, where they are transferred to a transfer material 211 (such as paper) having come fed there in synchronization with the rotation of the photosensitive member. In what is shown in this drawing, the four image forming units 212*a* to 212*d* operate interlockingly in series and stated color images are superimposingly formed on one transfer material 211.

Thus, the transfer material 211 is set to be synchronized with the image formation of the respective image forming units. That is, their image formation is set to be synchronized with the insertion of the transfer material 211. For that purpose, a transfer transport belt 217 which transports the transfer material 211 is put over a drive roller 218, a tension roller 219 and a follow-up roller 220 which are for the transfer transport belt 217, in such a way that it is held between the photosensitive members 205 and the image transfer assemblies 210. Then, the transfer material 211 is transported in the form that it is kept electrostatically attracted to the transfer transport belt 217 by the action of an attraction roller 221. Reference numeral 222 denotes a feed roller for feeding the transfer material 211.

The transfer material 211 to which the toner images have been transferred is stripped from the transfer transport belt 217 by the action of a stripping assembly 223, and then sent to a fixing assembly 224, where the toner images are fixed to the transfer material 211, thus printing is completed. Meanwhile, the photosensitive members 205 from which the toner images have been transferred to the transfer material 211 are further rotated, where the surfaces of the photosensitive members 205 are cleaned by the cleaning assemblies 209, and are optionally destaticized by a destaticizing assembly (not shown). Thereafter, the photosensitive members 205 are used for the next image formation.

In FIG. 2A reference numerals 225 and 226 denote bias power sources for the attraction roller 221 and for the image transfer assemblies 210, respectively.

The apparatus has been described here taking the case of the tandem-type apparatus in which the respective-color toner images are directly transferred to the transfer material. However, image forming apparatus according to the following three embodiments may also fall into the category of the image forming apparatus according to the present invention as long as they have the developing roller according to the present invention.

1) A black-and-white monochrome image forming apparatus.

2) An image forming apparatus in which the respective-color toner images are first superimposed onto a transfer roller or a transfer belt, and then all are one-time transferred to the transfer material.

3) An image forming apparatus in which developing units for the respective colors are arranged on a rotor, or arranged in series to a photosensitive member.

In addition, the photosensitive member, the charging assembly, the developing assembly and so forth may be set not in the process cartridge, but directly in the image forming apparatus.

EXAMPLES

The present invention is described below in greater detail by giving Examples. These, however, by no means limit the present invention. Methods for evaluation and measurement made variously in Examples are described first. In the following, "part(s)" refers to "part(s) by mass".

Measurement of Particle Diameter of Carbon Black

Figure 9A:
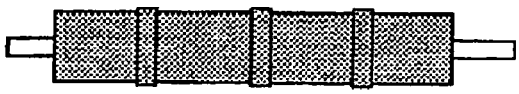
FIGS. 9A and 9B illustrate the positions of measurement on an elastic layer in the present invention.

The particle diameter of carbon black (CB) may be expressed as the value found by the following method. That is, samples are taken from a roller at its three portions obtained by, as shown in FIG. 9A, dividing the roller into four equal parts in its lengthwise direction. Stated specifically, a sharp-edged tool is vertically penetrated into the roller from its side until it reaches its shaft member, where, at the three portions each, the roller is cut into round slices of about few millimeters in thickness, and samples the cut surfaces of which are observable are picked up. Ultra-thin slices are prepared from among layers which are thickest at the cut surfaces, to use them as samples for observation. A cryosectioning system (trade name: Leica EM FCS; manufactured by Leica Mikrosysteme GmbH) is used in preparing the ultra-thin slices. As a knife therefor, a diamond knife (trade name: CRYODRY 350; manufactured by Diatome Co.) is used, and the samples and the knife are cooled to a temperature of −120° C. to −50° C., where ultra-thin slices are prepared which are about 50 nm in thickness. The three samples for observation thus prepared are each observed at their three spots (the vicinity of the surface, the part between the elastic layer surface and the shaft member, and the vicinity of the shaft member) on a transmission electron microscope. Direct observation is made at 140,000 magnifications. A film on which photographs have been taken is developed in a size enlarged twice to finally obtain photographic images enlarged 280,000 times.

From the photographic images obtained, 20,000 particles of carbon black are picked out at random, and the particle diameter is measured for each carbon black particle. Here, where the particles of carbon black which have arbitrarily been picked out overlap with adjoining particles of carbon black to a large extent, the particle diameters of such particles of carbon black are not measured and other particles are picked out. That is, particles the contours of which themselves are not recognizable because of their aggregation are not used for the calculation of particle diameter. How to judge whether particles overlap with adjoining particles of carbon black to a large extent or to a small extent is described with reference to FIG. 3.

Figure 3:
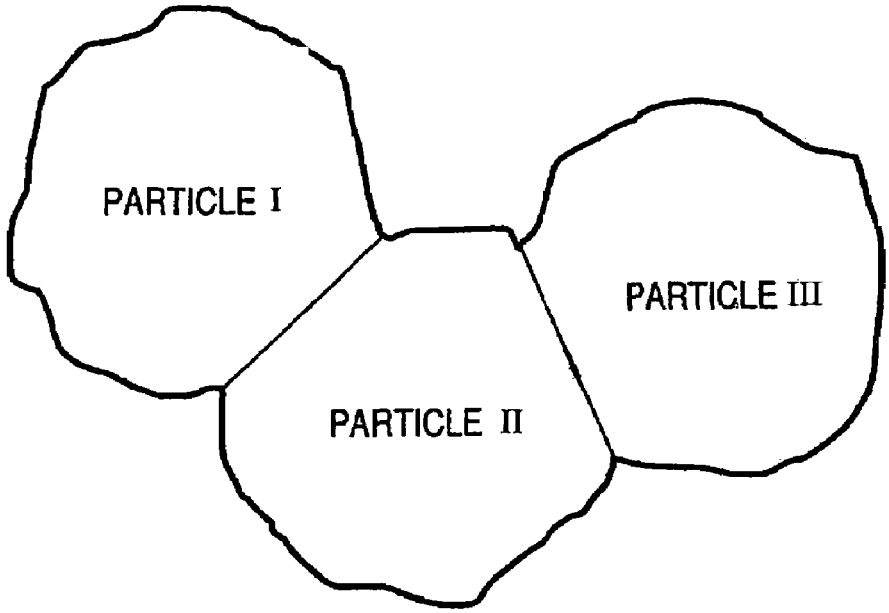
FIG. 3 illustrates how the particle diameter of carbon black in the present invention is determined.
Figure 4:
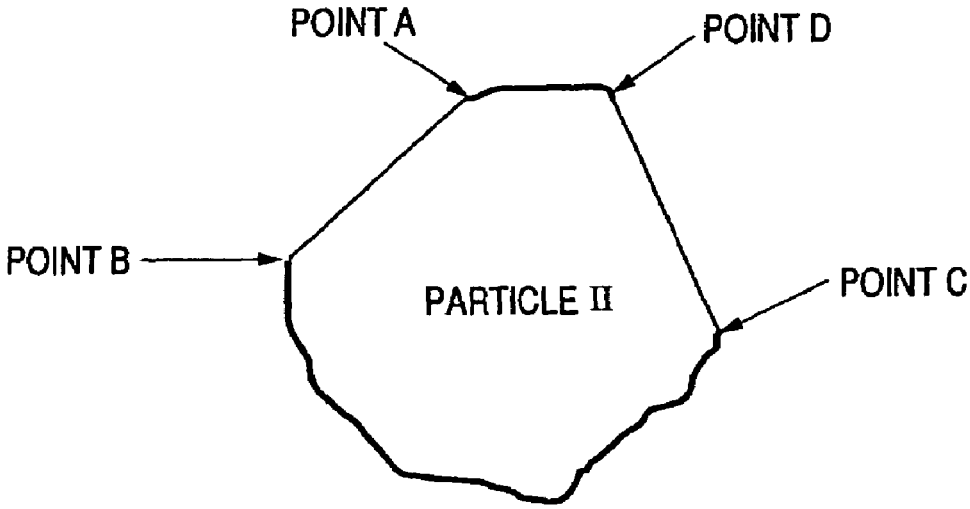
FIG. 4 illustrates how the particle diameter of carbon black in the present invention is determined.

In what is shown in FIG. 3, a carbon black particle II at the middle is in contact with two adjoining carbon black particles I and III, and hence any accurate contour of the particle II is unclear. However, the carbon black is a substance which may easily form aggregates (structures), and its particles almost overlap with one another as shown in FIG. 3. As shown in FIG. 4, two points (denoted as a point A and a point B) at which contour lines of the particles II and I intersect are connected with a straight line. A point C and a point D are also likewise determined in respect of the particles II and III, and are connected with a straight line. Thus, a closed plane is made which is connected with a straight line A-B, a curved line B-C, a straight line C-D and a curved line D-A. Where the sum of the length of the line segment A-B and length of the line segment C-D is 40% or less of the sum of the length of the curved line A-D and length of the curved line B-C and at the same time the length of the curved line B-C is 50% or more of the length of a line A-B-C-D-A, the particle is judged to overlap with its adjoining particles of carbon black to a small extent. Then, the diameter of a circle formed from an arbitrary one point on the curved line A-D and two points which divide the curved line B-C into three equal parts, three points in total, is calculated. The diameter (unit: nm) thus calculated is rounded off at the first decimal place and made into an integer, and the value found is defined to be the particle diameter of the particle II.

As to the particle I where the length of a curved line A-B is 70% or more of the sum of the length of the straight line A-B and length of the curved line A-B, the particle is judged to overlap with its adjoining particles of carbon black to a small extent. Then, the diameter of a circle formed from the point A, the point B and one point which divides the curved line A-B into two equal parts, three points in total, is calculated. The diameter thus calculated is rounded off at the first decimal place and made into an integer, and the value found is defined to be the particle diameter of the particle I.

As to the particle III, too, where the length of a curved line C-D is 70% or more of the sum of the length of the straight line C-D and length of the curved line C-D, the particle is judged to overlap with its adjoining particles of carbon black to a small extent. Then, the diameter of a circle formed from the point C, the point D and one point which divides the curved line C-D into two equal parts, three points in total, is calculated. The diameter thus calculated is rounded off at the first decimal place and made into an integer, and the value found is defined to be the particle diameter of the particle III.

According to foregoing procedure, the diameter is determined on each of the 20,000 particles picked out at random as above.

How to determine Peak in Particle Size Number Distribution

Figure 5:
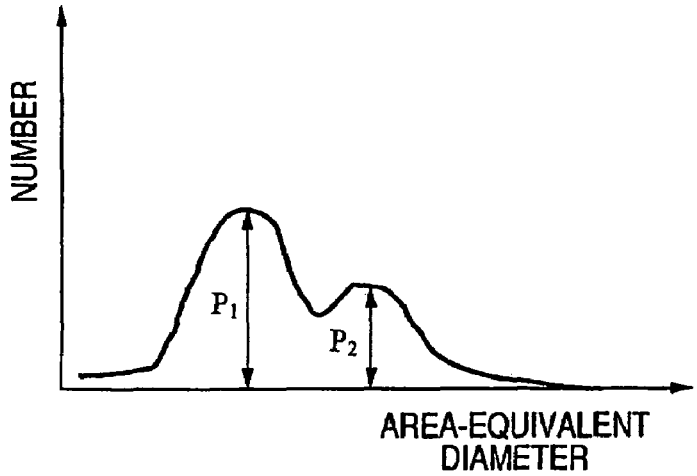
FIG. 5 is a graph showing the particle size distribution of carbon black in the present invention.
Figure 6A:
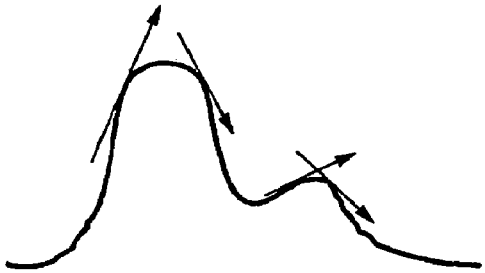
FIGS. 6A and 6B illustrate how peaks are distinguished which are to be determined from the particle size distribution of carbon black in the present invention.
Figure 6B:
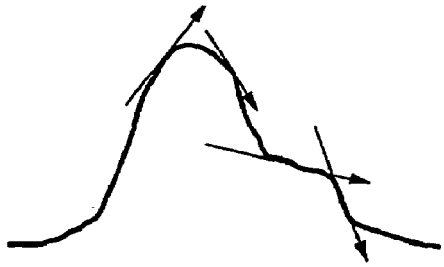

Particle diameters determined from the 20,000 particles are shown on a histogram. As shown in FIG. 5, the minimum diameter peak (the first peak from the left side in the graph) among peaks in the histogram obtained is denoted as a peak $P_1$. At this point, the highest position (the part that is largest in number) is regarded as the peak center. Then, the ratio of the particle number at the peak center of the peak $P_1$ to those of peaks obtained, comes to the peak number ratio of the peak $P_1$. How to distinguish the number of peaks is also shown in FIGS. 6A and 6B. Tangent lines are drawn on histogram curves, and the part where their slants change from plus to minus is regarded as one peak (FIG. 6A). For example, in the case of a shoulder peak, it is not regarded as a peak unless it is found that the slants of tangent lines change from plus to minus (FIG. 6B). FIG. 6A shows a case recognized as two peaks, and FIG. 6B shows a case not recognized as two peaks. The class width of the histogram is set to be the geometric progression (a multiple of 1.1) of E24 sequence, and the class mark is set to be 40.

Measurement of Density

Samples are cut out of the elastic layer of the developing roller, and their densities are measured with a solid density measuring instrument (trade name: SGM-200; manufactured by Shimadzu Corporation). About 3 cc of a sample is used for each measurement, and 9 cc of samples for measurement made three times are taken out, where an average value in the measurement made three times is termed as the density of the elastic layer.

Measurement of Carbon Black Level 10 mg each of samples are collected as specimens from the elastic layer at its three portions obtained by dividing the roller into four equal parts in its lengthwise direction and at three spots thereof further in their depth directions (the vicinity of the surface, the part between the elastic layer surface and the shaft member, and the vicinity of the shaft member), nine spots in total. The level of carbon black in each sample is measured according to JIS K 6227:1998 by using ThermoPlus2 TG8120, manufactured by Rigaku Denki K.K., and average values obtained are used as measured data. As measuring conditions, nitrogen gas is flowed at 200 ml/min., during which the sample is kept at 50° C. for 5 minutes, and thereafter heated to 800° C. at a rate of 50° C./min. to make all organic components decompose thermally. On the basis of weight loss coming at this point, information is obtained on the ratio of organic components (polymers) in the rubber component. Further, the sample is cooled to 300° C. at a rate of 50° C./min, where it is kept for 5 minutes to make it stable. Next, the nitrogen gas is switched to air, which was flowed at 200 ml/min., during which the sample is likewise heated to 900° C. at a rate of 50° C./min. On the basis of weight loss coming in this course, information is obtained on the weight of carbon black in the rubber component. From its relation to the ratio to the whole constituent substances, the content (% by mass) of the carbon black is found.

Measurement of C/Si Element Ratios

Figure 7A:
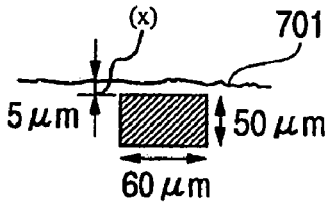
FIGS. 7A and 7B illustrate the positions of measurement on an elastic layer in the present invention.
Figure 7B:
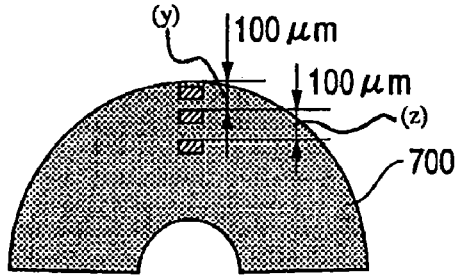

A sharp-edged tool is vertically penetrated into the roller from its side until it reaches its shaft member, where the roller is cut into round slices of about few millimeters in thickness to prepare samples the sections of which are observable. The samples are taken from the roller at its three portions obtained by dividing the part of the elastic layer into four equal parts in the lengthwise direction of the roller, where concentrations of elements are measured at stated three positions, (x), (y) and (z) detailed later, and average values found from the data at the three spots are used as measured data. As a measuring instrument, an energy-dispersive X-ray analyzer (manufactured by EDAX Japan K.K.) attached to an electron microscope (trade name: S4800; manufactured by Hitachi Ltd.) is used, and the measurement is made at an accelerating voltage of 20 kV and a dwell time of 100 seconds. Regarding the measuring positions, as to (x), as shown in FIG. 7A, it is set at a position of about 5 μm in depth from an elastic layer surface 701. As to (y) and (z), as shown in FIG. 7B, they are set at positions of 100 μm and 200 μm in depth, respectively, from the surface of an elastic layer 700. The electron microscope is set at 2,000 magnifications, and direct observation images (about 50 μm in length ×about 60 μm in width) at the same magnifications are used for the measurement. The data obtained are inputted to the above analyzer, and a software (trade name: eDX ZAF32 Ver. 3.0 (J)) attached thereto is used, where carbon atoms and silicon atoms are picked out to make quantitative determination. Stated specifically, the quantitative determination is made at a peak width of 0.24 eV or more to 0.28 cV or less about the carbon atoms and at a peak width of form 1.71 eV or more to 1.76 eV or less about the silicon atoms, to determine the C/Si element ratios.

Measurement of Carbon Black Area-equivalent Proportion

Figure 8A:
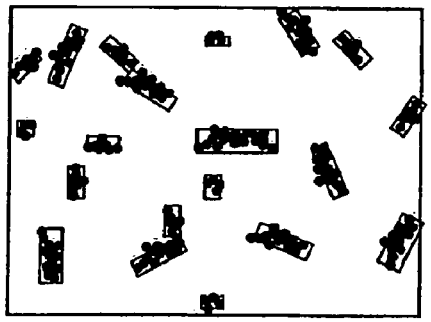
FIGS. 8A and 8B illustrate how the proportion of carbon black in the present invention is determined.
Figure 8B:
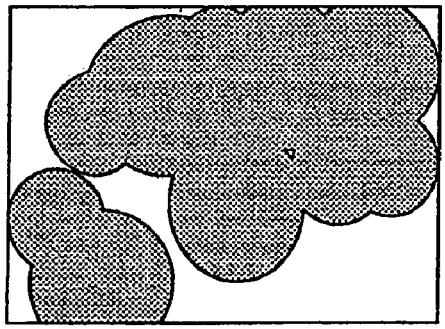

Samples are taken in the same way as those in the measurement of C/Si element ratios. Samples are taken from a roller at its three portions obtained by dividing the roller into four equal parts in its lengthwise direction, and images are so photographed on 10 sheets as not to overlap with one another at the respective portions. Using direct observation images enlarged 10,000 times, particles are classified into all agglomerated units as shown in FIG. 8A, from particle-shaped ones seen in the images. The respective agglomerated units are picked out, and, as shown in FIG. 8B, electron irradiation areas are so narrowed that such particles hold 60% or more on images, where irradiation with electrons is carried out. As a measuring instrument, an energy-dispersive X-ray analyzer (manufactured by EDAX Japan K.K.) attached to an electron microscope (trade name: S4800; manufactured by Hitachi Ltd.) is used, and the atomic ratio (atomic %) is measured at an accelerating voltage of 10 kV and a dwell time of 100 seconds. In this measurement, particles having the ratio of atomic % of carbon (C) to atomic % of oxygen (O), C/O, of 2.0 or more are termed as carbon black particles, and those having that of less than 2.0 are termed as particles other than the carbon black particles. From the images on 30 sheets, the area of the carbon black particles and the area of the particles other than the carbon black particles are summed up, and the area of the carbon black particles among these areas is calculated as its proportion.

Measurement of Roller Resistance Value

To measure the resistance value of the conductive elastic layer of the present invention, the roller is left in environments of high temperature/high humidity: temperature 30° C./humidity 85% RH and low temperature/low humidity: temperature 15° C./humidity 10% RH, for 24 hours or more. Thereafter, in each environment, the developing roller is pressed against a cylindrical metallic roller (diameter: 30 mm) under a constant-pressure load of 500 g on one side and is rotated at 60 rpm, in the sate of which a DC voltage of 50 V is applied to the developing roller, where its resistance value is measured.

Measurement of Thickness of Elastic Layer

Figure 9B:
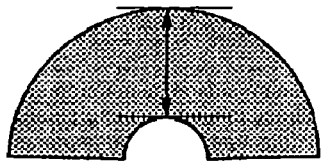

A sharp-edged tool is vertically penetrated into the roller from its side until it reaches its shaft member to prepare samples the sections of which are observable. Samples taken from a roller at its three portions obtained by, as shown in FIG. 9A, dividing the roller into four equal parts in its lengthwise direction are used, and layers which are largest in wall thickest are measured with a video-microscope (trade name: VHX100; manufactured by Keyence Corporation). Average values found from the data at the three spots are used to determine the thickness of the elastic layer (FIG. 9B).

Measurement of Yield Stress

How to measure yield stress of a liquid rubber material by using a viscoelasticity measuring instrument (trade name: RheoStress600; manufactured by Haake Co.) is described below.

About 1 g of the material is collected and then placed on a sample stand, and a cone-plate (cone and plate) is slowly brought near thereto, where a measuring gap is set at a position of about 50 μm from the sample stand (one having a diameter of 35 mm and a cone angle of 1° is used as the cone-plate). When it is set, the material pushed out to the surrounding is completely removed so as not to affect the measurement. The temperature of the sample plate is set so that the material has a temperature of 25° C. The material is set and then left for 10 minutes, and thereafter the measurement is started. Stress applied to the sample is changed within the range of from 0.00 Pa at the start up to 50,000 Pa (frequency: 1 Hz) over a period of 180 seconds, where changes in G' (storage elastic modulus), G" (loss elastic modulus) and phase difference (tanδ) are measured at 32 points. The G' first comes to a constant value in the region of linear viscoelasticity, and thereafter the value of stress at the point where the G' and G" intersect is read, which is termed as the yield stress.

Ghost Image Evaluation

The developing roller is set in a developing cartridge like that shown by reference numeral 208 in FIG. 2A This cartridge is left for 24 hours in an environment of a temperature of 15° C. and a humidity of 10%, and thereafter, in the same environment, mounted to the main body of an image forming apparatus (trade name: Color Laser Jet 3700 (600 dpi); manufactured by HP Co.) having been altered to be of 1,200 dpi. Then, as images for evaluation on ghost images, pattern images are reproduced, having solid regions (value measured with Macbeth densitometer: 1.3) of 15 mm×15 mm in size which are arranged in a row at intervals of 15 mm and, at the lower part thereof, a halftone region (value measured with Macbeth densitometer: 0.3).

In such pattern images, the same patterns as the solid regions may appear in blanks (white empty spaces) in the halftone region. In the present invention, this is defined to be "ghost images". Then, the images for evaluation on images are visually observed to make evaluation on whether or not, or to what extent, the ghost images appear, according to the following criteria.

Example 1

Formulation of Liquid Silicone Rubber Composition

The following materials were mixed to prepare a liquid silicone rubber composition.

- Molecular-chain both-end dimethylsiloxyl group-terminated dimethylpolysiloxane (vinyl group content: 0.15% by mass): 100 parts.
- Molecular-chain both-end trimethylsiloxyl group-terminated dimethylsiloxane-methylhydrogensiloxane copolymer (content of H atoms bonded to Si atoms: 0.30% by mass) as a cross-linking agent: 1.5 parts.
- Complex of chloroplatinic acid with divinyltetramethyldisiloxane (0.5% by mass): 0.5 part.
- 1-Ethyl-1-cyclohexanol: 0.04 part.
- Carbon black (CB-1): 5.7 parts.
- Carbon black (CB-5): 7.9 parts.

Details of the carbon blacks used in this Example are shown in Table 1.

TABLE 1

| Carbon black | Trade name *1 | Average primary particle diameter (nm) *2 |
|---|---|---|
| CB-1 | Raven 890 | 30 |
| CB-2 | Raven 3600U | 11 |
| CB-3 | Raven 860U | 39 |
| CB-4 | Raven 500 | 53 |
| CB-5 | Raven 410 | 101 |
| CB-6 | Raven 5000UII | 8 |

*1: available from Columbian Chemical Company
*2: catalogue value

Production of Elastic Roller

To a ring coating machine having the ring type coating head as shown in FIG. 1, a shaft member of 6 mm in outer diameter and made of iron was fastened with the shaft member holding shafts (the shaft member upper part holding shaft 10 and the shaft member lower part holding shaft 9) of the machine.

The clearance between the shaft member 102 and the ring-shaped coating head 8, which was 12.0 mm in inner diameter, was set to be 3.0 mm.

The shaft member holding shafts were vertically moved upward (at a rate of 60 mm/second) to move the shaft member. At the same time therewith, the above liquid silicone rubber composition was ejected at an ejection rate of 5,040 $mm^3$/second to form a layer of a cylindrical (roller-shaped) uncured product composed of the liquid silicone rubber composition, on the peripheral surface of the shaft member.

Next, this layer of an uncured product was subjected to infrared heating. An infrared heating lamp (HYL25, manufactured by Hybec Corporation) was set at a heat treatment temperature (surface temperature of the member to be heated) of 200° C. (output: 1,000 W), and was so set up that the distance between the lamp and the layer surface of an uncured product was 60 mm. Then, the shaft member provided with the layer of an uncured product was, while it was rotated at 60 rpm in its peripheral direction, heated for 4 minutes to cure the layer of an uncured product to form an elastic layer. Thereafter, the silicone rubber elastic layer having been cured was, for the purposes of, e.g., stabilizing its physical properties and removing reaction residues and unreacted low-molecular content, subjected to secondary curing at a temperature of 200° C. for 4 hours in an electric oven. The formulation proportion and yield stress of the liquid silicone rubber composition and the thickness of the elastic layer formed are shown in Table 2.

Formation of Surface Layer

The following materials were, with the addition of methyl ethyl ketone (MEK), dispersed for 1 hour by means of a sand mill.

Polyurethane polyol prepolymer (trade name: TAKELAC TE5060; available from Mitsui Takeda Chemicals, Inc.): 100 parts.

Isocyanate (trade name: COLONATE 2521; available from Nippon Polyurethane Industry Co., Ltd.): 77 parts.

Carbon black (trade name: MA100; available from Mitsubishi Chemical Corporation): 24 parts.

After dispersion, MEK was further added to make adjustment of solid content within the range of from 20% by mass or more to 30% by mass or less (so as to be 20μm in layer thickness) to prepare a raw-material fluid for surface layer formation. The above-described elastic roller was immersed in this raw-material fluid, and then drawn up, followed by natural drying. Subsequently, this was heat-treated at a temperature of 140° C. for 60 minutes to cause the surface layer raw material to cure. Thus, an elastic roller was obtained on which a surface layer was formed.

A variety of characteristics and physical properties of the elastic layer are shown in Tables 3-1 and 3-2. The results of image evaluation made by using the elastic roller according to this Example are also shown in Table 3-3.

Example 2

An elastic roller with a surface layer was produced in the same way as in Example 1 except that the carbon blacks were changed for the following ones. Using this elastic roller as Developing Roller 2, images were formed and evaluated in the same way as in Example 1. A variety of characteristics and physical properties of the elastic layer are shown in Tables 3-1 and 3-2. The results of image evaluation are shown in Table 3-3.

Carbon black (CB-2): 14.5 parts.

Carbon black (CB-4): 6.0 parts.

Example 3

An elastic roller with a surface layer was produced in the same way as in Example 1 except that the carbon blacks were changed for the following ones. Using this elastic roller as Developing Roller 3, images were formed and evaluated in the same way as in Example 1. A variety of characteristics and physical properties of the elastic layer are shown in Tables 3-1 and 3-2. The results of image evaluation are shown in Table 3-3.

Carbon black (CB-3): 4.3 parts.

Carbon black (CB-5): 3.2 parts.

Example 4

An elastic roller with a surface layer was produced in the same way as in Example 1 except that, as the shaft member made of iron, a shaft member was used which was 11 mm in outer diameter (both end portions were kept to be 6 mm in outer diameter). Using this elastic roller as Developing Roller 4, images were formed and evaluated in the same way as in Example 1. A variety of characteristics and physical properties of the elastic layer are shown in Tables 3-1 and 3-2. The results of image evaluation are shown in Table 3-3.

Example 5

An elastic roller with a surface layer was produced in the same way as in Example 1 except that, as the shaft member made of iron, a shaft member was used which was 4 mm in outer diameter (both end portions were kept to be 6 mm in outer diameter) and that the ejection rate of the liquid silicone rubber composition was so adjusted that the elastic layer was formed in a thickness of 6.0 mm. Using this elastic roller as Developing Roller 5, images were formed and evaluated in the same way as in Example 1. A variety of characteristics and physical properties of the elastic layer are shown in Tables 3-1 and 3-2. The results of image evaluation are shown in Table 3-3.

Example 6

An elastic roller with a surface layer was produced in the same way as in Example 1 except that the carbon blacks were used in amounts shown below and that 0.7 part of silica (average primary particle diameter: 1.7 μm; NIPSIL E-220A, available from Nippon Silica Industrial Co., Ltd.) was mixed. Using this elastic roller as Developing Roller 6, images were formed and evaluated in the same way as in Example 1. A variety of characteristics and physical properties of the elastic layer are shown in Tables 3-1 and 3-2. The results of image evaluation are shown in Table 3-3.

Carbon black (CB-1): 5.7 parts.

Carbon black (CB-5): 8.0 parts.

Example 7

An elastic roller with a surface layer was produced in the same way as in Example 1 except that the carbon blacks were changed for the following ones. Using this elastic roller as Developing Roller 7, images were formed and evaluated in the same way as in Example 1. A variety of characteristics and physical properties of the elastic layer are shown in Tables 3-1 and 3-2. The results of image evaluation are shown in Table 3-3.

Carbon black (CB-3): 2.8 parts.
Carbon black (CB-4): 10.7 parts.

Example 8

An elastic roller with a surface layer was produced in the same way as in Example 1 except that the carbon blacks were changed for the following ones. Using this elastic roller as Developing Roller 8, images were formed and evaluated in the same way as in Example 1. A variety of characteristics and physical properties of the elastic layer are shown in Tables 3-1 and 3-2. The results of image evaluation are shown in Table 3-3.

Carbon black (CB-2): 9.0 parts.
Carbon black (CB-5): 3.4 parts.

Example 9

An elastic roller with a surface layer was produced in the same way as in Example 1 except that the carbon blacks were changed for the following ones. Using this elastic roller as Developing Roller 9, images were formed and evaluated in the same way as in Example 1. A variety of characteristics and physical properties of the elastic layer are shown in Tables 3-1 and 3-2. The results of image evaluation are shown in Table 3-3.

Carbon black (CB-1): 4.5 parts.
Carbon black (CB-4): 3.4 parts.
Carbon black (CB-5): 4.5 parts.

Example 10

An elastic roller with a surface layer was produced in the same way as in Example 6 except that the amount of the silica was changed to 1.7 parts. Using this elastic roller as Developing Roller 10, images were formed and evaluated in the same way as in Example 1. A variety of characteristics and physical properties of the elastic layer are shown in Tables 3-1 and 3-2. The results of image evaluation are shown in Table 3-3.

Example 11

An elastic roller with a surface layer was produced in the same way as in Example 5 except that the material ejection rate was so adjusted that the elastic layer was formed in a thickness of 6.5 mm. Using this elastic roller as Developing Roller 11, images were formed and evaluated in the same way as in Example 1. A variety of characteristics and physical properties of the elastic layer are shown in Tables 3-1 and 3-2. The results of image evaluation are shown in Table 3-3.

Comparative Example 1

An elastic roller with a surface layer was produced in the same way as in Example 1 except that the carbon blacks were changed for the following ones. Using this elastic roller as Developing Roller 12, images were formed and evaluated in the same way as in Example 1. A variety of characteristics and physical properties of the elastic layer are shown in Tables 3-1 and 3-2. The results of image evaluation are shown in Table 3-3.

Carbon black (CB-2): 3.2 parts.
Carbon black (CB-4): 2.1 parts.

Comparative Example 2

An elastic roller with a surface layer was produced in the same way as in Example 1 except that the carbon blacks were changed for the following ones. Using this elastic roller as Developing Roller 13, images were formed and evaluated in the same way as in Example 1. A variety of characteristics and physical properties of the elastic layer are shown in Tables 3-1 and 3-2. The results of image evaluation are shown in Table 3-3.

Carbon black (CB-1): 7.5 parts.
Carbon black (CB-5): 17.5 parts.

Comparative Example 3

An elastic roller with a surface layer was produced in the same way as in Example 1 except that the carbon blacks were changed for the following ones. Using this elastic roller as Developing Roller 14, images were formed and evaluated in the same way as in Example 1. A variety of characteristics and physical properties of the elastic layer are shown in Tables 3-1 and 3-2. The results of image evaluation are shown in Table 3-3.

Carbon black (CB-4): 5.7 parts.
Carbon black (CB-5): 7.9 parts.

Comparative Example 4

An elastic roller with a surface layer was produced in the same way as in Example 1 except that the carbon blacks were changed for the following ones. Using this elastic roller as Developing Roller 15, images were formed and evaluated in the same way as in Example 1. A variety of characteristics and physical properties of the elastic layer are shown in Tables 3-1 and 3-2. The results of image evaluation are shown in Table 3-3.

Carbon black (CB-6): 5.7 parts.
Carbon black (CB-4): 7.9 parts.

Comparative Example 5

An elastic roller with a surface layer was produced in the same way as in Example 1 except that the carbon blacks were changed for the following one. Using this elastic roller as Developing Roller 16, images were formed and evaluated in the same way as in Example 1. A variety of characteristics and physical properties of the elastic layer are shown in Tables 3-1 and 3-2. The results of image evaluation are shown in Table 3-3.

Carbon black (CB-1): 13.6 parts.

Comparative Example 6

An elastic roller before formation of a surface layer was produced in the same way as in Example 1 except that the carbon blacks were changed for the following ones.

Carbon black (CB-6): 5.7 parts.
Carbon black (CB-4): 7.9 parts.

A raw-material fluid for intermediate layer formation was also prepared in the same way as in Example 1 except that the amount of the carbon black (trade name: MA100; available from Mitsubishi Chemical Corporation) in the raw-material fluid for surface layer formation was changed to 40 parts. Using this raw-material fluid, an intermediate layer of 10 μm was formed on the peripheral surface of the above elastic layer. On this intermediate layer, a surface layer was formed in the same way as in Example 1, using the same raw-material fluid for surface layer formation as that in Example 1. Using as Developing Roller 17 the elastic roller with the surface layer and intermediate layer, thus obtained, images were formed and evaluated in the same way as in Example 1. A variety of characteristics and physical properties of the elastic layer are shown in Tables 3-1 and 3-2. The results of image evaluation are shown in Table 3-3.

Comparative Example 7

A liquid silicone rubber composition for elastic layer formation was prepared in the same way as in Example 1 except that the carbon blacks were changed for the following ones. A first elastic layer was formed on the peripheral surface of a shaft member in the same way as in Example 1 except that this liquid silicone rubber composition was used and also its ejection rate was changed to 4,972 $mm^3$/second, to obtain an elastic roller of 11.8 mm in diameter.

Carbon black (CB-4): 5.7 parts.

Carbon black (CB-5): 7.9 parts.

Next, a liquid silicone rubber composition for elastic layer formation was prepared in the same way as in Example 1 except that the carbon blacks were changed for the following one. A second elastic layer of 0.1 mm in thickness was formed on the peripheral surface of the first elastic layer in the same way as in Example 1 except that this liquid silicone rubber composition was used and also its ejection rate was changed to 68 $mm^3$/second, to obtain an elastic roller of 12.0 mm in diameter.

Carbon black (CB-1): 27.0 parts.

Next, a surface layer was formed on the peripheral surface of the second elastic layer in the same way as in Example 1, to obtain an elastic roller with the surface layer. About this elastic roller, when the first and second elastic layers were regarded as one elastic layer, its C/Si element ratios (X/Y, Y/Z) were found to be 1.80 and 1.06, respectively. Using this elastic roller as Developing Roller 18, images were formed and evaluated in the same way as in Example 1. The results of image evaluation are shown in Table 3-3.

TABLE 2

| | Carbon black | | | Yield value of liquid | Thickness |
|---|---|---|---|---|---|
| | Type | Parts by mass | Parts by mass | silicone rubber composition (Pa) | of elastic layer (mm) |
| Example 1 | CB-1<br>CB-5 | 13.6 | 0 | 150 | 3.0 |
| Example 2 | CB-2<br>CB-4 | 20.5 | 0 | 600 | 3.0 |
| Example 3 | CB-3<br>CB-5 | 7.5 | 0 | 20 | 3.0 |
| Example 4 | CB-1<br>CB-5 | 13.6 | 0 | 150 | 0.5 |
| Example 5 | CB-1<br>CB-5 | 13.6 | 0 | 150 | 6.0 |
| Example 6 | CB-1<br>CB-5 | 13.7 | 0.7 | 150 | 3.0 |
| Example 7 | CB-3<br>CB-4 | 13.5 | 0 | 80 | 3.0 |
| Example 8 | CB-2<br>CB-5 | 12.4 | 0 | 300 | 3.0 |
| Example 9 | CB-1<br>CB-4<br>CB-5 | 12.4 | 0 | 15 | 3.0 |
| Example 10 | CB-1<br>CB-5 | 13.7 | 1.7 | 140 | 3.0 |
| Example 11 | CB-1<br>CB-5 | 13.6 | 0 | 150 | 6.5 |
| Comparative Example 1 | CB-2<br>CB-4 | 5.3 | 0 | 6 | 3.0 |
| Comparative Example 2 | CB-1<br>CB-5 | 25 | 0 | 200 | 3.0 |
| Comparative Example 3 | CB-4<br>CB-5 | 13.6 | 0 | 50 | 3.0 |
| Comparative Example 4 | CB-4<br>CB-6 | 13.6 | 0 | 300 | 3.0 |
| Comparative Example 5 | CB-1 | 13.6 | 0 | 200 | 3.0 |
| Comparative Example 6 | CB-4<br>CB-6 | 13.6 | 0 | 300 | 3.0 |
| Comparative Example 7 | CB-4<br>CB-5 | 13.6 | 0 | For first elastic layer formation: 50 | 2.9 |
| | CB-1 | 27.0 | 0 | For second elastic layer formation: 500 | 0.1 |

TABLE 3-1

| | Carbon black | | | | |
|---|---|---|---|---|---|
| | Peak center Value of particle diameter (nm) *1 | % by mass *2 | Number of peaks in particle size number distribution (peaks) *3 | Peak number ratio of minimum diameter peak (%) *4 | Carbon black area-equivalent proportion (%) *5 |
| Example 1 | 33<br>108 | 13.0 | 2 | 50 | 100 |
| Example 2 | 10<br>60 | 17.0 | 2 | 70 | 100 |
| Example 3 | 40<br>108 | 7.0 | 2 | 50 | 100 |
| Example 4 | 33<br>108 | 13.3 | 2 | 50 | 100 |
| Example 5 | 33<br>108 | 12.4 | 2 | 50 | 100 |
| Example 6 | 33<br>108 | 12.8 | 2 | 50 | 95 |

TABLE 3-1-continued

| | Carbon black | | | | |
|---|---|---|---|---|---|
| | Peak center Value of particle diameter (nm) *1 | % by mass *2 | Number of peaks in particle size number distribution (peaks) *3 | Peak number ratio of minimum diameter peak (%) *4 | Carbon black area-equivalent proportion (%) *5 |
| Example 7 | 40<br>60 | 12.5 | 2 | 25 | 100 |
| Example 8 | 10<br>108 | 11.2 | 2 | 78 | 100 |
| Example 9 | 33<br>60<br>108 | 11.1 | 3 | 40 | 100 |
| Example 10 | 33<br>108 | 12.0 | 2 | 50 | 90 |
| Example 11 | 33<br>108 | 12.0 | 2 | 50 | 100 |
| Comparative Example 1 | 10<br>60 | 5.6 | 2 | 60 | 100 |
| Comparative Example 2 | 33<br>108 | 20.3 | 2 | 30 | 100 |
| Comparative Example 3 | 60<br>108 | 12.4 | 2 | 50 | 100 |
| Comparative Example 4 | 9<br>60 | 12.6 | 2 | 60 | 100 |
| Comparative Example 5 | 33 | 12.2 | 1 | 100 | 100 |
| Comparative Example 6 | 9<br>60 | 12.6 | 2 | 60 | 100 |

*1: Carbon black particle diameter determined by the particle diameter measuring method.
*2: The level of carbon black in the layer-constituent material, determined by the carbon black level measuring method.
*3: The number of peaks found from the histogram of particle size distribution.
*4: The peak number ratio of the minimum diameter peak found from the histogram of particle size distribution.
*5: The area-equivalent proportion of carbon black particles, found by the carbon black area-equivalent proportion measuring method.

TABLE 3-2

| | Density of elastic layer (g/cm$^3$) | Element ratios X/Y | Element ratios Y/Z |
|---|---|---|---|
| Example 1 | 1.04 | 1.40 | 1.07 |
| Example 2 | 1.07 | 1.13 | 1.02 |
| Example 3 | 1.01 | 1.20 | 1.04 |
| Example 4 | 1.04 | 1.14 | 1.03 |
| Example 5 | 1.04 | 1.50 | 1.10 |
| Example 6 | 1.04 | 1.15 | 1.04 |
| Example 7 | 1.04 | 1.36 | 1.06 |
| Example 8 | 1.03 | 1.10 | 1.02 |
| Example 9 | 1.04 | 1.13 | 1.03 |
| Example 10 | 1.05 | 1.15 | 1.04 |
| Example 11 | 1.04 | 1.30 | 1.05 |
| Comparative Example 1 | 1.00 | 0.95 | 0.99 |
| Comparative Example 2 | 1.08 | 1.01 | 1.01 |
| Comparative Example 3 | 1.04 | 1.05 | 1.02 |
| Comparative Example 4 | 1.04 | 0.98 | 0.99 |
| Comparative Example 5 | 1.04 | 0.92 | 0.94 |
| Comparative Example 6 | 1.04 | 0.98 | 0.99 |

TABLE 3-3

| | Image evaluation results |
|---|---|
| Example 1 | A |
| Example 2 | B |
| Example 3 | B |
| Example 4 | B |
| Example 5 | A |
| Example 6 | B |
| Example 7 | B |
| Example 8 | C |
| Example 9 | C |
| Example 10 | C |
| Example 11 | B |
| Comparative Example 1 | E |
| Comparative Example 2 | D |
| Comparative Example 3 | D |
| Comparative Example 4 | D |
| Comparative Example 5 | D |
| Comparative Example 6 | D |
| Comparative Example 7 | F |

Evaluation Results:

As shown in Table 3-3, the developing rollers obtained in Examples 1 to 11 did not cause any ghost images that may come into question on evaluation. In particular, in the developing rollers obtained in Examples 1 and 5, having strong slants of carbon black particles in the vicinity of the elastic layer surface, very good images were obtained in which any ghost images were not recognized at all and further any bias leak occurred.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-111784, filed Apr. 20, 2007, which is hereby incorporated by reference herein in its entirety.

What is claimed is:

1. A developing roller comprising:

a conductive shaft member;

a conductive elastic layer formed around the shaft member in a thickness of 0.5 mm to 6.0 mm; and a surface layer, wherein the elastic layer contains carbon black and silicone rubber serving as a binder for the carbon black, the carbon black is in a content of 7% by mass to 17% by mass based on the mass of the elastic layer, the carbon black in the elastic layer has at least two peaks in its particle size number distribution, a minimum diameter peak center in the particle size number distribution is within the range of 10 nm to 40 nm, the elastic layer has density within the range of 1.01 g/cm$^3$ to 1.07 g/cm$^3$, and where a ratio of carbon atoms to silicon atoms (C/Si) in the vicinity of the surface of the elastic layer is represented by X, the ratio of carbon atoms to silicon atoms at a depth of 100 μm from the surface of the elastic layer by Y, and the ratio of carbon atoms to silicon atoms at a depth of 200 μm from the surface of the elastic layer by Z, the X, the Y and the Z satisfy the relationships of the following expressions:

$$1.50 \geqq X/Y \geqq 1.10, \text{ and}$$

$$1.10 \geqq Y/Z \geqq 1.02.$$

2. The developing roller according to claim 1, wherein a peak number ratio of the minimum diameter peak in the particle size number distribution is from 25% or more to 70% or less.

3. The developing roller according to claim 1, wherein an area equivalent proportion of the carbon black to whole fillers in the silicone rubber is from 95% or more to 100% or less.

4. A production process of the developing roller according to claim 1, comprising the steps of:

providing a shaft member on its outer peripheral side with a ring type coating head in such a way that the coating head is concentric with the shaft member, and, while moving the shaft member in its axial direction relatively with respect to the coating head, feeding a liquid silicone rubber composition from the coating head toward the peripheral surface of the shaft member to form a layer of the liquid silicone rubber composition around the shaft member; and curing the liquid silicone rubber composition, wherein the liquid silicone rubber composition is a composition obtained by mixing carbon blacks in a liquid silicone rubber in such a way that the carbon blacks may have at least two peaks in its particle size number distribution and that the minimum diameter peak center in the particle size number distribution may be within the range of 10 nm or more to 40 nm or less.

5. A process cartridge, which is detachably mounted to a main body of an image forming apparatus, the process cartridge comprising:

a developing assembly having a developing roller;

a developer; and a developer container holding the developer therein, wherein the developing roller is the developing roller according to claim 1.

6. An image forming apparatus comprising:

a developer roller; and a photosensitive member, wherein a layer of a developer is formed on a surface of the developing roller, and the layer of a developer is transported to the photosensitive member on which an electrostatic latent image has been formed, to develop the electrostatic latent image, and wherein the developing roller is the developing roller according to claim 1.

* * * * *